US006997109B2

(12) United States Patent
Saito

(10) Patent No.: US 6,997,109 B2
(45) Date of Patent: Feb. 14, 2006

(54) PLATE REMOVING APPARATUS HAVING TWO COVER MEMBERS

(75) Inventor: Nobuaki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 11/001,986

(22) Filed: Dec. 1, 2004

(65) Prior Publication Data

US 2005/0120900 A1 Jun. 9, 2005

(30) Foreign Application Priority Data

Dec. 9, 2003 (JP) ..... 2003-410566

(51) Int. Cl.
*B41L 31/00* (2006.01)
*B41F 27/12* (2006.01)

(52) U.S. Cl. ..... 101/477; 101/415.1

(58) Field of Classification Search ..... 101/477, 101/415.1; B41L 31/00
See application file for complete search history.

(56) References Cited

U.S. PATENT DOCUMENTS 5,127,328 A * 7/1992 Wieland ..... 101/415.1
5,595,119 A * 1/1997 Hada et al. ..... 101/477
6,561,093 B1 5/2003 Onuma et al.

FOREIGN PATENT DOCUMENTS

EP 1352739 4/2003

* cited by examiner

*Primary Examiner*—Leslie J. Evanisko
(74) *Attorney, Agent, or Firm*—Blakely Sokoloff Taylor & Zafman

(57) ABSTRACT

A plate removing apparatus includes a plate cylinder, cover, loader, cover members, and plate removal port. The plate cylinder is rotatably supported between a pair of frames opposing each other through a predetermined distance. The cover is provided to a front side of the plate cylinder and supported between the pair of frames. The loader swings between a closing position to close at least part of a space formed between the pair of frames and an opening position to open the space. The cover members move from a retreat position to an operative position, when the loader is located at the opening position, to close the space opened by the loader. The plate removal port is formed in the cover members. A plate mounted on the plate cylinder is removed through the plate removal port when the cover members are located at the operative position.

10 Claims, 7 Drawing Sheets

PLATE REMOVING APPARATUS HAVING TWO COVER MEMBERS

BACKGROUND OF THE INVENTION

The present invention relates to a plate removing apparatus for manually removing a plate mounted on a plate cylinder.

A conventional plate removing apparatus has, as shown in U.S. Pat. No. 6,561,039, a plate cylinder rotatably supported by a pair of frames opposing each other through a predetermined distance, a cover which is provided in front of the plate cylinder and has an opening for plate exchange and the like, and a plate making unit which is supported to be movable between a position to cover the opening of the cover and a position to open the opening and makes a plate at the position to cover the opening. In the plate removing apparatus having this structure, when the plate is to be removed, the plate making unit is moved to the position to open the opening. The plate released by the plate clamp of the plate cylinder is removed through the opened opening.

In the conventional plate removing apparatus described above, when the plate is to be removed, the front surface of the plate cylinder is opened to be set in the open state. A tool or rag may erroneously enter a printing unit through the opening. When the tool or rag enters the printing unit, not only it scratches or damages the plate cylinder or an ink roller, but also the printing press itself may break down.

SUMMARY OF THE INVENTION

It is an object of the present invention to provide a plate removing apparatus which prevents a plate cylinder, ink roller, and the like from being scratched or damaged, and simultaneously failure of the printing press itself.

In order to achieve the above object, according to the present invention, there is provided a plate removing apparatus comprising a plate cylinder rotatably supported between a pair of frames opposing each other through a predetermined distance, a first cover member provided to a front side of the plate cylinder and supported between the pair of frames, a swing member which swings between a closing position to close at least part of a space formed between the pair of frames and an opening position to open the space, a second cover member which moves from a retreat position to an operative position, when the swing member is located at the opening position, to close the space opened by the swing member, and an open portion which is formed in the second cover member and through which a plate mounted on the plate cylinder is removed when the second cover member is located at the operative position.

DESCRIPTION OF THE PREFERRED EMBODIMENT

A plate removing apparatus according to an embodiment of the present invention will be described with reference to FIGS. 1 to 11.

Figure 1:
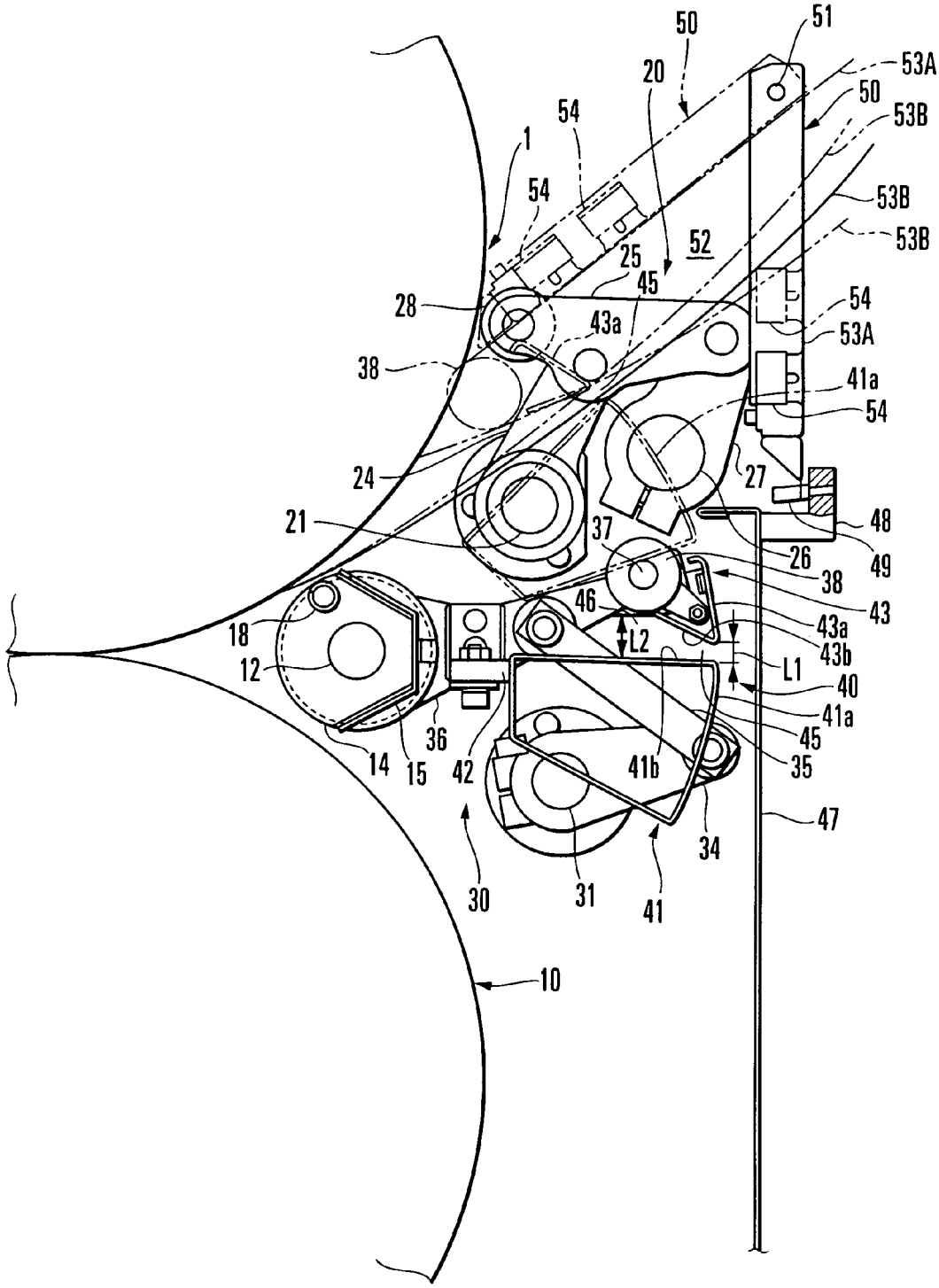
FIG. 1 is a side view of the main part of a plate removing apparatus according to an embodiment of the present invention.
Figure 2:
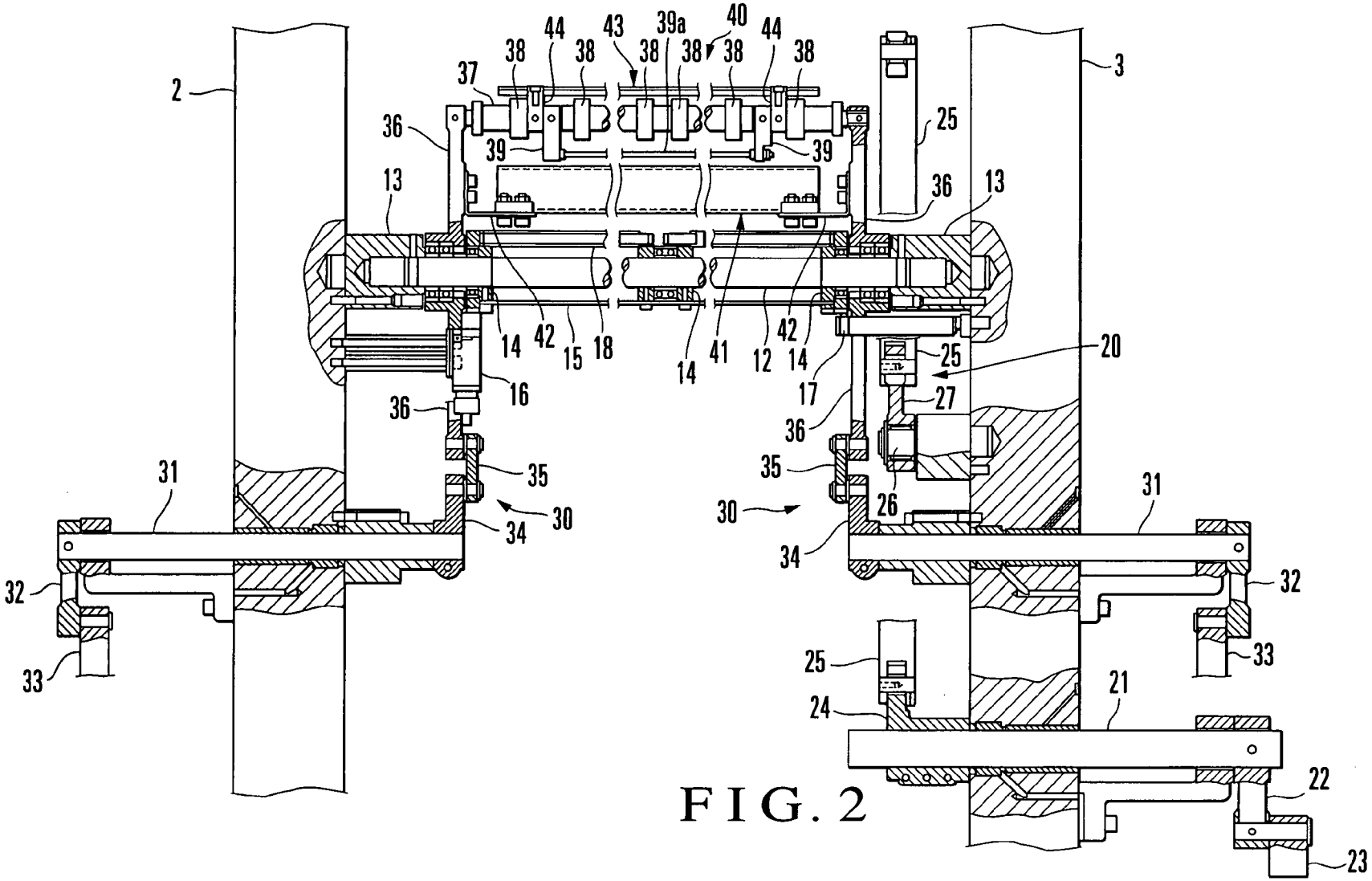
FIG. 2 is a partially cutaway front view in which the plate removing apparatus shown in FIG. 1 is developed.
Figure 3:
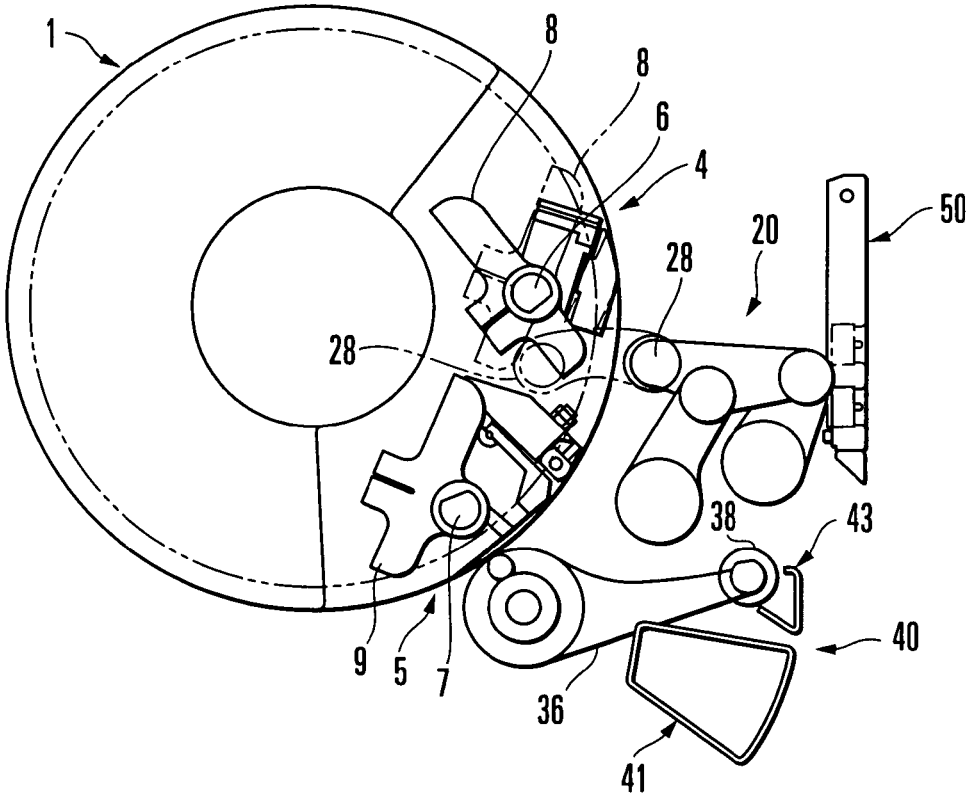
FIG. 3 is a side view for explaining the opening operation of a leading edge plate clamp in the plate removing apparatus shown in FIG. 1.

As shown in FIGS. 1 to 3, a leading edge plate clamp 4 which grips the leading edge of a plate and a trailing edge plate clamp 5 which grips the trailing edge of the plate are arranged in a notch formed in the outer surface of a plate cylinder 1 rotatably supported by a pair of frames 2 and 3. The leading edge plate clamp 4 and trailing edge plate clamp 5 grip and release the plate by swinging cam levers 8 and 9, axially mounted on a leading edge cam shaft 6 and trailing edge cam shaft 7, respectively, projecting from the end face of the plate cylinder 1 with a gripping change wheel 28 (to be described later). As shown in FIG. 1, a blanket cylinder 10 is disposed in contact with the plate cylinder 1, and rotatably supported by the frames 2 and 3.

As shown in FIG. 2, a fixed shaft 12 is fixed between the frames 2 and 3 through a pair of fixing elements 13. A safety bar 15 extending in the axial direction of the fixed shaft 12 is rotatably supported by the fixed shaft 12 through three cylindrical brackets 14. A groove (not shown) extending in the axial direction is formed in part of the outer surface of each of the brackets 14 on the two sides. An actuating element of a limit switch 16 attached to the frame 2 is engaged in the groove on the frame 2 side. A ball plunger 17 attached to the frame 3 through a stud is engaged in the groove on the frame 3 side.

In this structure, when a tool or the like comes into contact with the safety bar 15 and the safety bar 15 pivots against the posture holding force of the ball plunger 17, the limit switch 16 is actuated to perform a control operation of stopping rotation of the plate cylinder 1 and blanket cylinder 10. A cylindrical plate guide bar 18 having substantially the same length as that of the safety bar 15 is attached between the brackets 14 on the two sides to be parallel to the fixed shaft 12.

A gripping change unit 20 which causes the leading edge plate clamp 4 and trailing edge plate clamp 5 to grip and release the plate will be described.

A pivot shaft 21, the axial movement of which is regulated, is rotatably supported by the frame 3. The proximal end of a lever 22 is axially mounted on that projecting end of the pivot shaft 21 which projects outside the frame 3. One end of a lever 23 is pivotally mounted on the swing end of the lever 22. The other end of the lever 23 is connected to the rod (not shown) of a first air cylinder having a cylinder end pivotally mounted on the frame 3. When the rod moves forward or backward, the pivot shaft 21 pivots through the levers 23 and 22.

The proximal end of a lever 24 is axially mounted on the projecting end of the pivot shaft 21 inside the frame 3. The swing end of the lever 24 is pivotally mounted on the central portion of a wheel lever 25. The proximal end of a lever 27 is pivotally supported by a shaft 26 vertically extending from the frame 3. The swing end of the lever 27 is pivotally mounted on one end of the wheel lever 25. In this structure, the levers 24 and 27 and the wheel lever 25 form a four-articulated link. When the pivot shaft 21 pivots clockwise or counterclockwise in FIG. 1, the wheel lever 25 moves forward or backward together with the levers 24 and 27 in the radial direction of the plate cylinder 1.

The gripping change wheel 28, which selectively corresponds to the cam levers 8 and 9 in accordance with the pivot phase of the plate cylinder 1, is pivotally mounted on the other end of the wheel lever 25. As the wheel lever 25 moves forward or backward, the cam lever 8 or 9 is swung by the gripping change wheel 28 in a range between the position indicated by a solid line and the position indicated by an alternate long and two short dashed line in FIG. 3. When the cam lever 8 or 9 swings, the leading edge cam shaft 6 or trailing edge cam shaft 7 pivots.

More specifically, when the leading edge cam shaft 6 pivots counterclockwise in FIG. 3 and the cam lever 8 is positioned at the position indicated by the solid line, the plate is gripped by the leading edge plate clamp 4. When the leading edge cam shaft 6 pivots clockwise and the cam lever 8 is positioned at the position indicated by the alternate long and two short dashed line, the plate gripped by the leading edge plate clamp 4 is released.

Figure 4:
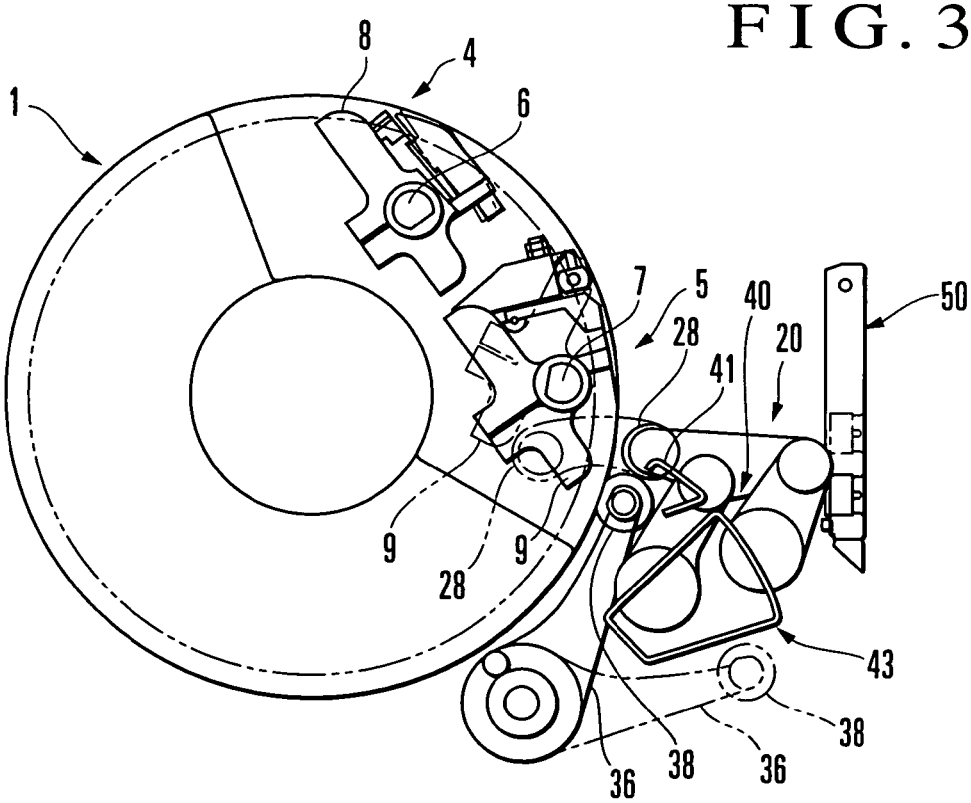
FIG. 4 is a side view for explaining the opening operation of a trailing edge plate clamp in the plate removing apparatus shown in FIG. 1.

When the trailing edge cam shaft 7 pivots counterclockwise in FIG. 4 and the cam lever 9 is positioned at the position indicated by a solid line, the plate is gripped by the trailing edge plate clamp 5. When the trailing edge cam shaft 7 pivots clockwise and the cam lever 9 is positioned at the position indicated by an alternate long and two short dashed line, the plate gripped by the trailing edge plate clamp 5 is released.

A plate pressing unit 30 will be described with reference to FIGS. 1 and 2.

Referring to FIG. 2, the proximal ends of levers 32 are axially mounted on those projecting ends of pivot shafts 31 which project outside the frames 2 and 3, respectively. The pivot shafts 31 are supported by the frames 2 and 3 such that the pivot shafts 31 are rotatable but their axial movement is regulated. One end of each lever 33 is pivotally mounted on the swing end of the corresponding lever 32. The other end of each lever 33 is connected to the rod of the corresponding one of two second air cylinders (not shown) serving as actuators. The cylinder ends of the two second air cylinders are pivotally mounted on the frames 2 and 3, respectively. When the rods move forward or backward, the pivot shafts 31 pivot through the levers 33 and 32.

The proximal ends of levers 34 are axially mounted on those projecting ends of the pivot shafts 31 which project inside the frames 2 and 3, respectively. One end of each lever 35 is pivotally mounted on the swing end of the corresponding lever 34. The proximal ends of a pair of opposing wheel levers 36 are pivotally supported by the two ends of the fixed shaft 12. A shaft 37 horizontally extends between the swing ends of the wheel levers 36. A plurality of plate pressing wheels 38 are rotatably supported by the shaft 37 such that axial movement of the plate pressing wheels 38 is regulated. A flexure preventive lever 39*a* extends between fixing elements 39 axially mounted on the two end sides of the shaft 37, to be parallel to the shaft 37. The flexure preventive lever 39*a* regulates flexure of the shaft 37 which is generated when the plate is pressed against the outer surface of the plate cylinder 1 by the plate pressing wheels 38, as will be described later. The other end of each lever 35 is pivotally mounted on the central portion of the corresponding wheel lever 36.

In this structure, when the second air cylinders actuate in the first direction and the respective pivot shafts 31 pivot clockwise in FIG. 1, the wheel levers 36 pivot clockwise about the fixed shaft 12 as the center through the levers 35. Thus, the plate pressing wheels 38 are positioned at a wait position (separate position), as indicated by a solid line in FIG. 1, where the plate pressing wheels 38 are separate from the outer surface of the plate cylinder 1. When the second air cylinders actuate in the second direction opposite to the first direction and the pivot shafts 31 pivot counterclockwise in FIG. 1, the wheel levers 36 pivot counterclockwise about the fixed shaft 12 as the center through the levers 35. Thus, the plate pressing wheels 38 are positioned at a plate pressing position, as indicated by an alternate long and two short dashed line in FIG. 1, where the plate pressing wheels 38 press the plate against the outer surface of the plate cylinder 1.

Figure 7:
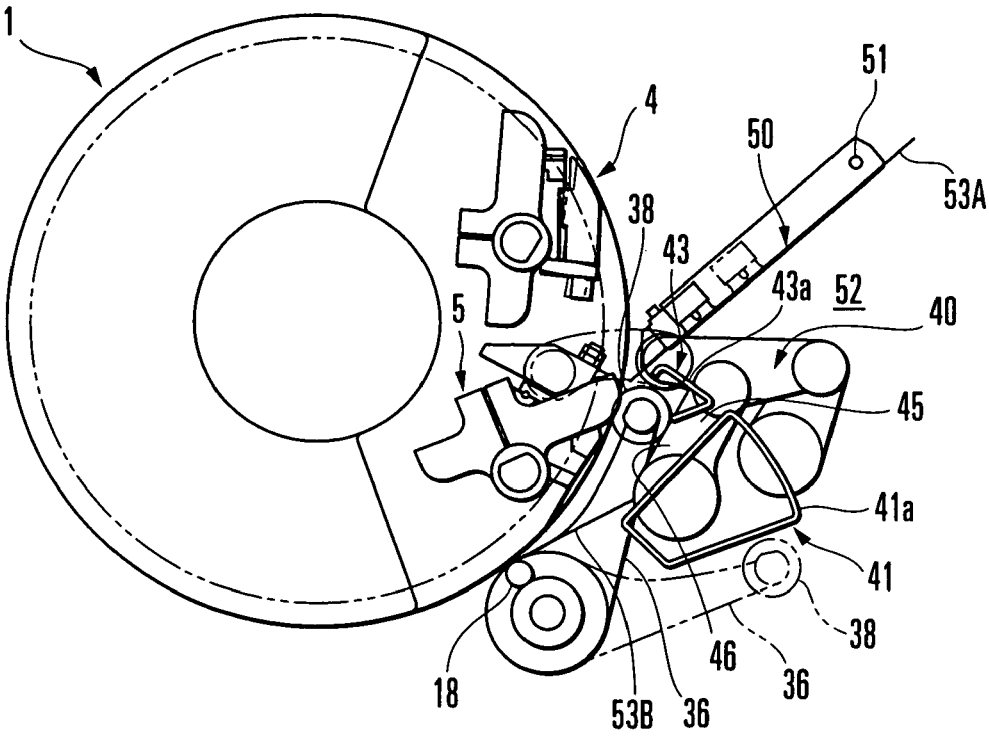
FIG. 7 is a side view showing a state in the plate removing apparatus shown in FIG. 1 wherein an open space between the swung loader and a cover is covered by a cover member.

A cover unit 40 will be described with reference to FIGS. 1, 2, and 7.

A lower cover member 41 serving as a second cover member has a substantially prismatic shape, as shown in FIG. 1, and is disposed to extend between the pair of wheel levers 36, as shown in FIG. 2. The two ends of the cover member 41 are attached to the wheel levers 36 through brackets 42. As shown in FIG. 1, the lower cover member 41 has a cover surface 41*a* opposing the inner surface of a cover 47 (to be described later) and having an arcuate section, and a lower plate guide portion 41*b* which is formed by bending the upper end of the cover surface 41*a* and extends linearly on the plate cylinder 1 side.

The two ends of an upper cover member 43 which has a V-shaped section and serves as the second cover member are attached to the two ends of the shaft 37 through brackets 44, such that the cover member 43 opposes the inner surface of the lower cover member 41, as shown in FIG. 2. As shown in FIG. 1, the upper cover member 43 has a cover surface 43*a* opposing the cover 47, and an upper plate guide portion 43*b* which is formed by bending the lower end of the cover surface 43*a* and extends linearly on the plate cylinder 1 side. The plate guide portions 41*b* and 43*b* are arranged to almost oppose each other in the direction of thickness of an old plate 53B which is to be removed, as will be described later.

A plate removal port 45 serving as an open portion extending along the shaft 37 is formed between the upper end of the cover surface 41*a* of the lower cover member 41 and the lower end of the cover surface 43*a* of the upper cover member 43. A plate introduction port 46 through which the plate is introduced to the plate guide portions 41*b* and 43*b* is formed on the plate cylinder 1 side which is opposite to the plate removal port 45 through the plate guide portions 41*b* and 43*b*. The space between the lower plate guide portion 41*b* and upper plate guide portion 43*b* gradually decreases from the plate introduction port 46 on the plate cylinder 1 side toward the plate removal port 45. More specifically, a space L1 of the plate removal port 45 in the direction of thickness of the old plate 53B to be removed is set smaller than a space L2 of the plate introduction port 46. In this case, the section of a shape formed by the plate guide portions 41*b* and 43*b*, plate removal port 45, and plate introduction port 46 in a direction perpendicular to the axial direction of the plate cylinder 1 is a triangle with a notched distal end.

As the pair of wheel levers 36 swing, the cover members 41 and 43 constituted in this manner move between a retreat position and operative position (to be described later while forming the plate introduction port 46 and plate removal port 45.

The two ends of the cover 47, which serves as the first cover member to cover the front sides of the plate cylinder 1 and blanket cylinder 10, are fixed to the frames 2 and 3. A plurality of plate positioning pins 49 are fixed to a bracket 48 fixed to the upper end of the cover 47. The upper end of a plate inserting loader 50 serving as a swing member to cover the front side of the plate cylinder 1 is swingably supported by the frames 2 and 3 through a pin 51. The loader 50 swings between a closing position indicated by a solid line to close a space 52 formed between the frames 2 and 3, and an opening position to close the space 52. When the loader 50 is at the closing position, the space 52 is closed by the loader 50 and the outer surface of the plate cylinder 1. Chucking pads 54 which chuck a new plate 53A are supported by the loader 50 to be vertically movable. When the loader 50 is at the opening position, the chucking pads 54 move downward, and the new plate 53A is inserted in the leading edge plate clamp 4 of the plate cylinder 1.

When the loader 50 is located at the closing position, the pins 49 are engaged in the U-shaped groove of the leading edge of the new plate 53A, and the new plate 53A is chucked by the chucking pads 54 as it is positioned in the circumferential direction. When the plate pressing wheels 38 are moved from the wait position and positioned at the operative position (alternate long and two short dashed line), the cover members 41 and 43 move interlocked with the plate pressing wheels 38 and are positioned at the operative position (alternate long and two short dashed line) to cover the opened space 52 between the loader 50, which has swung from the retreat position (solid line) to the open position in FIG. 1, and the cover 47. The old plate 53B on the plate cylinder 1 is removed through the plate removal port 45 formed by the cover members 41 and 43 located at the operative position.

The operation to remove the old plate and the operation to supply the new plate in the plate removing apparatus having the above structure will be described with reference to FIGS. 3 to 12.

As shown in FIG. 3, to open the leading edge plate clamp 4, the plate cylinder 1 is pivoted to a preset phase and stopped. Subsequently, the first air cylinder (not shown) actuates the gripping change wheel 28 to move from the position indicated by a solid line toward the center of the plate cylinder 1, as indicated by an alternate long and two short dashed line, and the cam lever 8 swings from the position indicated by the solid line to the position indicated by the alternate long and two short dashed line. As the cam lever 8 swings, the leading edge cam shaft 6 pivots clockwise in FIG. 3 to open the leading edge plate clamp 4. The leading edge of the old plate disengages from the leading edge plate clamp 4.

As shown in FIG. 4, to open the trailing edge plate clamp 5, the plate cylinder 1 is pivoted counterclockwise to a preset phase and stopped. Subsequently, the second air cylinders (not shown) actuate the plate pressing wheels 38 to move from the wait position indicated by an alternate long and two short dashed line to the plate pressing position, indicated by a solid line, to press the old plate against the outer surface of the plate cylinder 1. In this state, the first air cylinder actuates the gripping change wheel 28 to move from the position indicated by a solid line toward the center of the plate cylinder 1, as indicated by an alternate long and two short dashed line, and the cam lever 9 swings from the position indicated by a solid line to the position indicated by an alternate long and two short dashed line. As the cam lever 9 swings, the trailing edge cam shaft 7 pivots clockwise in FIG. 4 to open the trailing edge plate clamp 5. The trailing edge of the old plate disengages from the trailing edge plate clamp 5.

Figure 5:
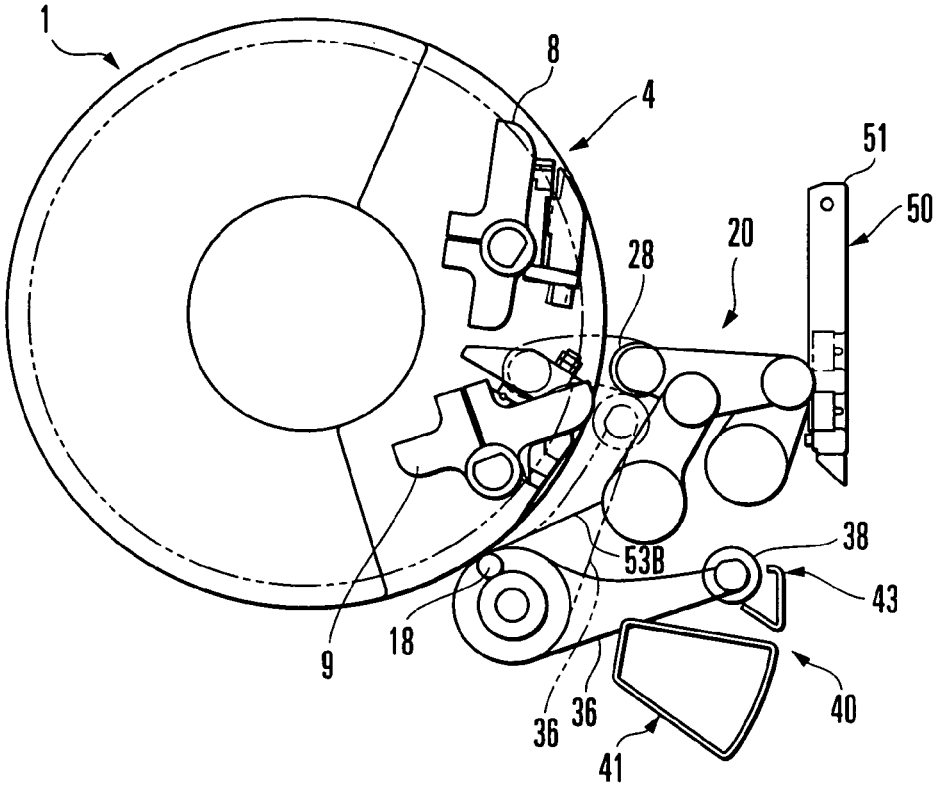
FIG. 5 is a side view showing a state in the plate removing apparatus shown in FIG. 1 wherein the trailing edge of an old plate disengages from the trailing edge plate clamp.

Subsequently, as shown in FIG. 5, the second air cylinders are actuated in the first direction, and the plate pressing wheels 38 move from the plate pressing position indicated by an alternate long and two short dashed line to the wait position, indicated by a solid line, where the plate pressing wheels 38 are separate from the outer surface of the plate cylinder 1 through the pair of wheel levers 36. At this time, following the movement of the plate pressing wheels 38, the trailing edge of the old plate 53B separates from the outer surface of the plate cylinder 1 and engages with the plate guide bar 18.

Figure 6:
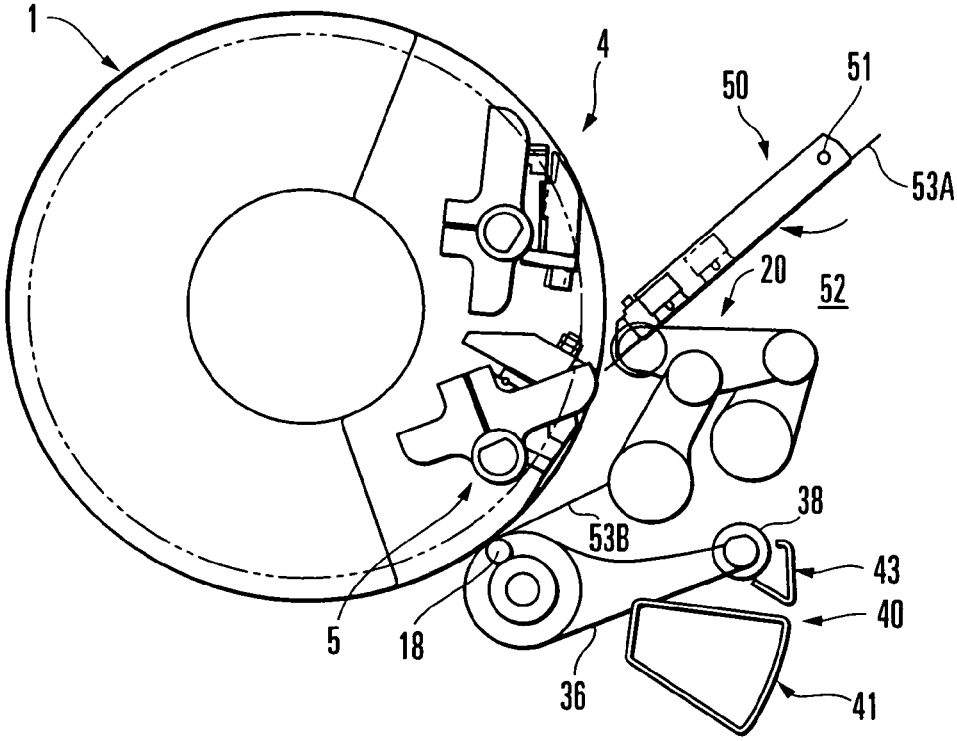
FIG. 6 is a side view showing a state in the plate removing apparatus shown in FIG. 1 wherein the distal end of a loader is close to the outer surface of a plate cylinder.

In this state, as shown in FIG. 6, the loader 50 swings substantially by 45° clockwise about the pin 51 as the center, and the distal end of the loader 50 comes close to the outer surface of the plate cylinder 1. Thus, the space 52 between the swung loader 50 and the cover 47 is opened.

Simultaneously, the second air cylinders are actuated in the second direction, and the pair of wheel levers 36 swing. As shown in FIG. 7, the plate pressing wheels 38 move from the wait position indicated by an alternate long and two short dashed line to the plate press position, indicated by a solid line, where the plate pressing wheels 38 press the plate against the outer surface of the plate cylinder 1. Interlocked with the swing motion of the wheel levers 36, the cover members 41 and 43 move to the operative position. At the operative position, the cover surfaces 41*a* and 43*a* of the cover members 41 and 43 cover the opened space 52 between the loader 50, located at the open position, and the cover 47. At this time, the cover surfaces 41*a* and 43*a* extend from the distal end of the loader 50 close to the outer surface of the plate cylinder 1 to the upper end of the cover 47. Even if a tool or rag is to be erroneously inserted through the opened space 52, the insertion is inhibited by the cover surfaces 41*a* and 43*a*. Therefore, the outer surface of the plate cylinder 1 can be prevented from being scratched or damaged by the tool, and the rag can be prevented from getting caught between rollers to cause failure of the printing press.

Figure 8:
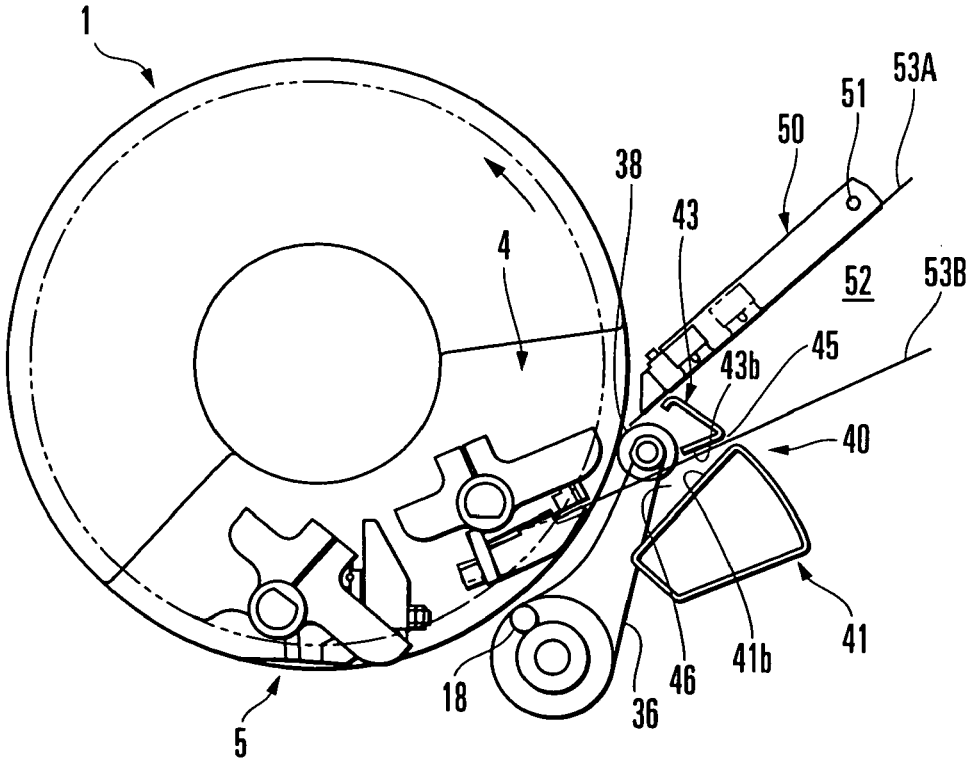
FIG. 8 is a side view showing a state in the plate removing apparatus shown in FIG. 1 wherein the old plate is removed through the plate removal port of the cover member.

In this state, when the plate cylinder 1 rotates counterclockwise as shown in FIG. 8, the old plate 53B is guided along the plate guide bar 18 to be in contact with the plate guide bar 18. The trailing edge of the old plate 53B is introduced between the two plate guide portions 41*b* and 43*b* through the plate introduction port 46 and removed from the plate removal port 45. At this time, the space L2 of the plate introduction port 46 in the direction of plate thickness is larger than the space L1 of the plate removal port 45. Thus, the trailing edge of the old plate 53B which has disengaged from the plate cylinder 1 can be reliably introduced between the two plate guide portions 41*b* and 43*b* through the plate introduction port 46. Also, the space L1 of the plate removal port 45 can be set at the minimum size. Thus, insertion of the tool or rag can be reliably regulated by the two cover surfaces 41*a* and 43*a*. The space between the lower plate guide portion 41*b* and upper plate guide portion 43*b* gradually decreases from the plate introduction port 46 on the plate cylinder 1 side toward the plate removal port 45. Thus, the old plate 53B introduced between the two plate guide portions 41*b* and 43*b* may not be bent but can be smoothly removed from the plate removal port 45.

Figure 9:
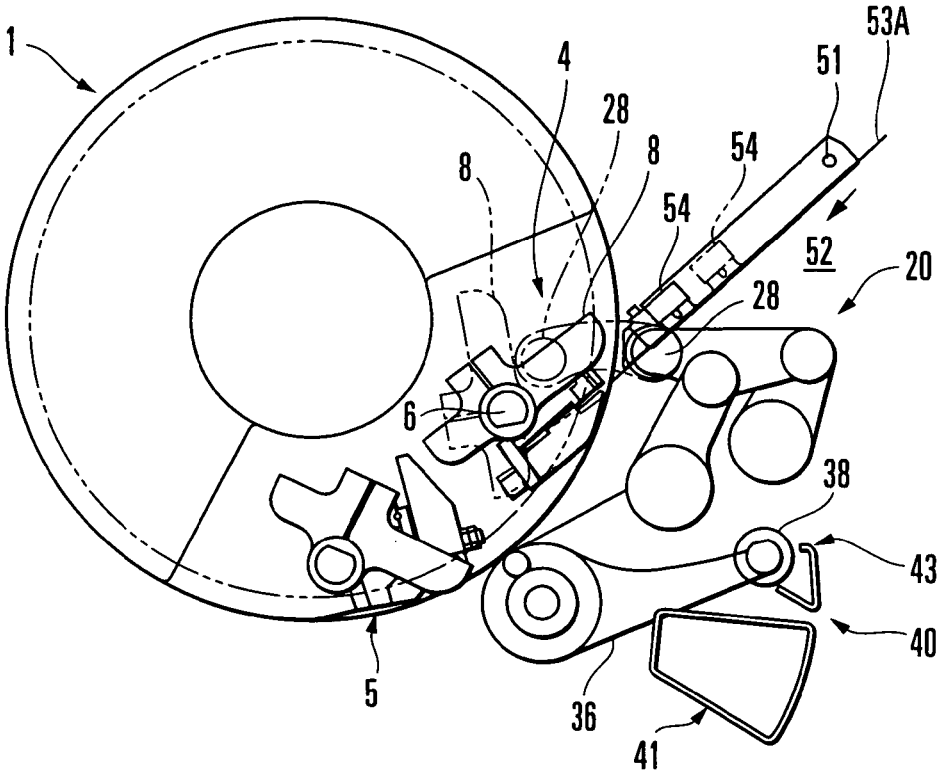
FIG. 9 is a side view showing a state in the plate removing apparatus shown in FIG. 1 wherein the leading edge of a new plate is to be gripped by the leading edge plate clamp.

After the old plate 53B is removed from the plate cylinder 1 and removed from the plate removal port 45, the second air cylinders are actuated in the first direction. Thus, as shown in FIG. 9, the pair of wheel levers 36 swing, and accordingly the plate pressing wheels 38 separate from the outer surface of the plate cylinder 1. As the wheel levers 36 swing, the cover members 41 and 43 also move in an interlocked manner from the operative position to the retreat position. In this state, to insert the new plate 53A in the leading edge plate clamp 4, the plate cylinder 1 is slightly pivoted counterclockwise to a preset phase to open the leading edge plate clamp 4, and stopped. The chucking pads 54 of the loader 50 which chuck the new plate 53A move to insert the leading edge of the new plate 53A in the leading edge plate clamp 4. In this state, the first air cylinder is actuated. According, the gripping change wheel 28 is moved from the position indicated by a solid line toward the center of the plate cylinder 1, as indicated by an alternate long and two short dashed line. Also, the cam lever 8 swings from the position indicated by a solid line to the position indicated by an alternate long and two short dashed line. As the cam lever 8 swings, the leading edge cam shaft 6 pivots counterclockwise in FIG. 9. Thus, the leading edge plate clamp 4 grips the leading edge of the new plate 53A.

Figure 10:
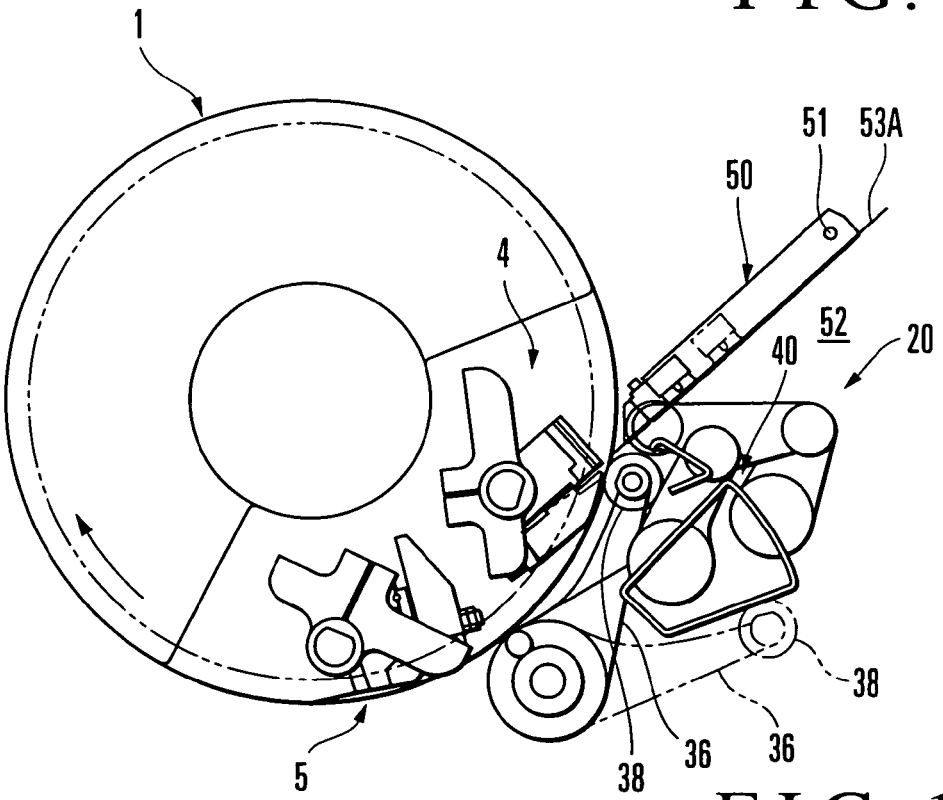
FIG. 10 is a side view showing an operation of winding the new plate around the outer surface of the plate cylinder in the plate removing apparatus shown in FIG. 1.

Subsequently, as shown in FIG. 10, the second air cylinders are actuated in the second direction. Accordingly, with the plate pressing wheels 38 being located at the plate pressing position, the plate cylinder 1 pivots clockwise in FIG. 10. At this time, the new plate 53A is wound around the plate cylinder 1 while the new plate 53A is pressed by the plate pressing wheels 38 against the outer surface of the plate cylinder 1.

Figure 11:
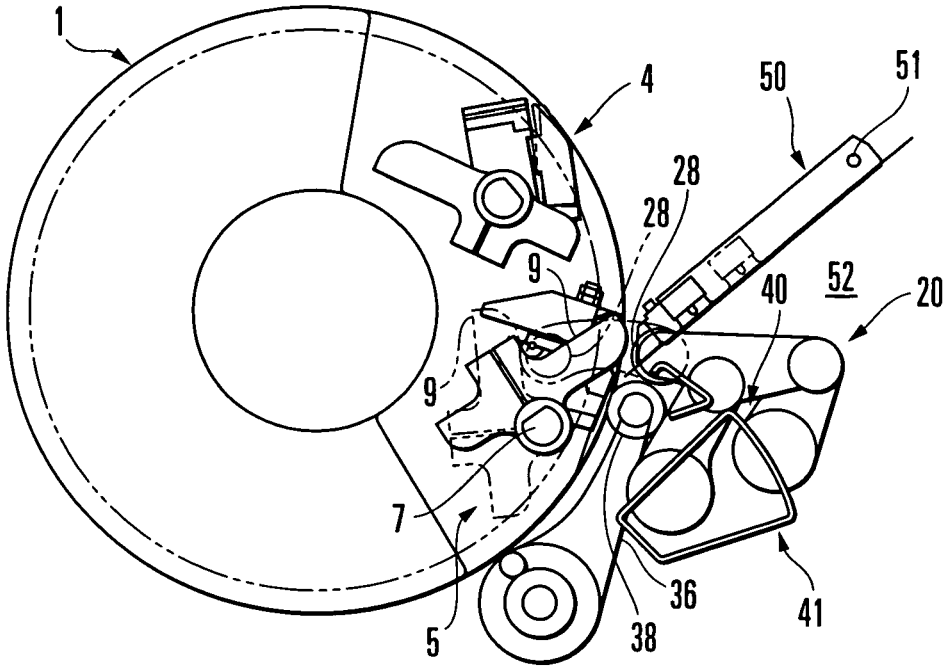
FIG. 11 is a side view showing a state in the plate removing apparatus shown in FIG. 1 wherein the new plate is mounted on the outer surface of the plate cylinder.

As shown in FIG. 11, the plate cylinder 1 pivots to a position where the trailing edge of the new plate 53A is gripped by the trailing edge plate clamp 5 of the plate cylinder 1, and is stopped. The trailing edge of the new plate 53A is inserted in the trailing edge plate clamp 5 by the plate pressing wheels 38. In this state, the first air cylinder is actuated. Accordingly, the gripping change wheel 28 moves from the position indicated by a solid line toward the center of the plate cylinder 1, as indicated by an alternate long and two short dashed line. Thus, the cam lever 9 swings from the position indicated by a solid line to the position indicated by an alternate long and two short dashed line. As the cam lever 9 swings, the trailing edge cam shaft 7 pivots counterclockwise in FIG. 11. Thus, the trailing edge of the new plate 53A is gripped by the trailing edge plate clamp 5, and the new plate 53A is mounted on the outer surface of the plate cylinder 1.

Figure 12:
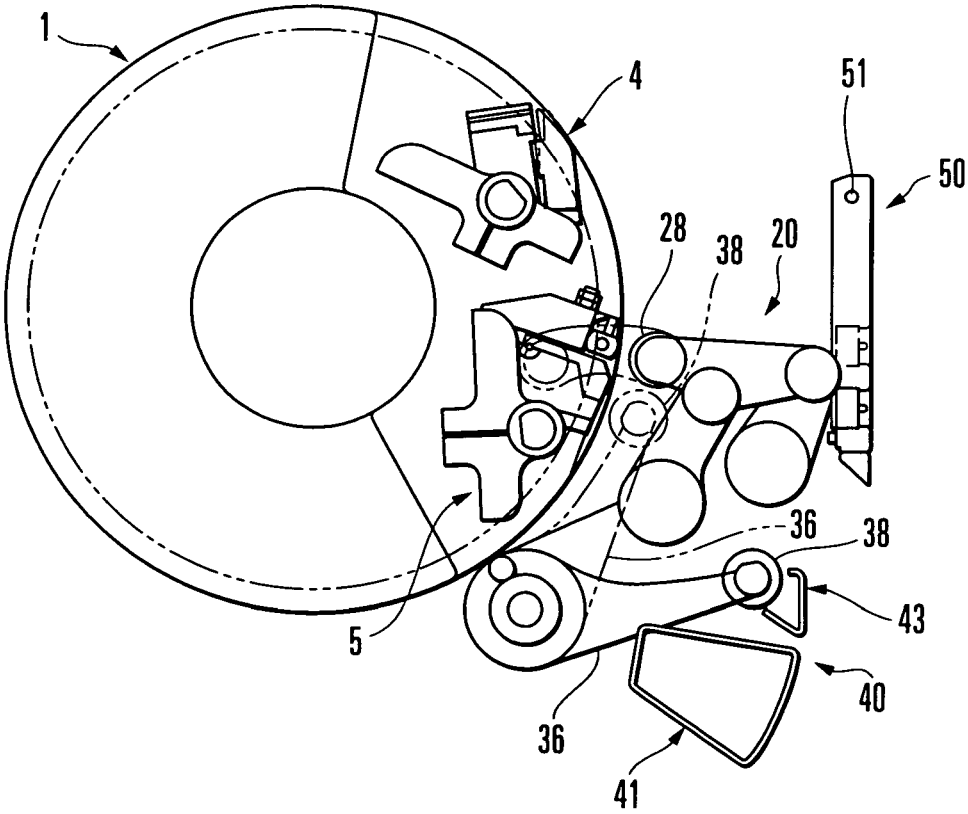
FIG. 12 is a side view showing a state in the plate removing apparatus shown in FIG. 1 wherein plate pressing wheels and a loader are restored to the initial positions.

Subsequently, the second air cylinders are actuated in the first direction. Thus, as shown in FIG. 12, the plate pressing wheels 38 move from the plate pressing position indicated by an alternate long and two short dashed line to the wait position, indicated by a solid line, where the plate pressing wheels 38 are separate from the outer surface of the plate cylinder 1. Simultaneously, the loader 50 swings counterclockwise about the pin 51 as the center, and the distal end of the loader 50 separates from the outer surface of the plate cylinder 1. Thus, the plate exchange operation is ended.

According to this embodiment, movement of the cover members 41 and 43 between the operative position and retreat position and movement of the plate pressing wheels 38 are performed integrally. Thus, no special units to move the cover members 41 and 43 are required. Hence, not only the number of components can be decreased, but also the structure can be simplified.

Although the cover members 41 and 43 are constituted by two members in this embodiment, they can be formed of one member. In this case, the plate removal port 45 may be formed as a slit. The plate removal port 45 is formed between the cover members 41 and 43. If a space through which the plate can be removed into the opened space 52 is formed by a cover member located at the operative position, no plate removal port 45 need be formed. Also, a through hole as a through window through which the interior of the printing press can be barely seen can be formed between the cover surfaces 41*a* and 43*a* of the cover members 41 and 43.

According to this embodiment, the space from the plate introduction port 46 to the plate removal port 45 is gradually decreased, and the two plate guide portions 41*b* and 43*b* are formed linearly. However, the present invention is not limited to this. The space from the plate introduction port 46 to the central portions of the plate guide portions 41*b* and 43*b* may be gradually decreased, and the space from the central portions to the plate removal port 45 may be formed with a constant size. More specifically, the two plate guide portions 41*b* and 43*b* may have funnel-like sections. Various changes can be made in the design of the plate guide portions 41*b* and 43*b*. The cover members 41 and 43 are moved together with the plate pressing wheels 38. Alternatively, exclusive driving means for the cover members 41 and 43 may be provided. As the swing member, the loader 50 which supplies the new plate 53A is used. Alternatively, a plate making unit which makes a plate may be used as the swing member. Various changes can be made in the design of the swing member.

As has been described above, according to the present invention, when the plate is to be removed, the opening on the front side of the plate cylinder is blocked by the cover surface of the cover member. The cover surface inhibits insertion of a tool or rag. Thus, the plate cylinder or ink roller can be prevented from being scratched or damaged, and failure of the printing press can be prevented.

The plate disengaging from the plate cylinder can be reliably introduced from the plate introduction port to the two plate guide portions. Also, the space of the plate removal port is set to have a minimum size. Thus, insertion of the tool or rag through the plate removal port can be regulated reliably.

No special units to move the cover members between the operative position and retreat position are required. Hence, not only the number of components can be decreased, but also the structure can be simplified.

What is claimed is:

1. A plate removing apparatus comprising:

a plate cylinder rotatably supported between a pair of frames opposing each other through a predetermined distance;

a first cover member provided to a front side of said plate cylinder and supported between said pair of frames;

a swing member which swings between a closing position to close at least part of a space formed between said pair of frames and an opening position to open the space;

a second cover member which moves from a retreat position to an operative position, when said swing member is located at the opening position, to close the space opened by said swing member; and an open portion which is formed in said second cover member and through which a plate mounted on said plate cylinder is removed when said second cover member is located at the operative position.

2. An apparatus according to claim 1, wherein said second cover member includes a cover surface which substantially covers the space opened between said swing member located at the opening position and said first cover member, and a plate removal port which forms said open portion is formed in said cover surface.

3. An apparatus according to claim 2, wherein when said second cover member is located at the operative position, said cover surface extends from a distal end of said swing member located at the opening position to an upper end of said first cover member.

4. An apparatus according to claim 2, wherein said second cover member further includes a plate introduction port in which a plate removed from said plate cylinder and to be removed is introduced, and a plate guide portion for guiding the plate introduced to the plate introduction port to the plate removal port.

5. An apparatus according to claim 4, wherein a space of the plate removal port in a direction of plate thickness is set to be smaller than a space of the plate introduction port.

6. An apparatus according to claim 5, wherein said plate guide portion includes a pair of plate guide members arranged to oppose each other in the direction of plate thickness, and a space between said pair of plate guide members is set to decrease gradually from the plate introduction port toward the plate removal port.

7. An apparatus according to claim 6, wherein a shape formed by said pair of plate guide members, plate introduction port, and plate removal port in a direction perpendicular to an axial direction of said plate cylinder has a substantially triangular section.

8. An apparatus according to claim 1, wherein said swing member comprises a loader which mounts a plate on said plate cylinder, and an opening position for said loader is where a distal end of said loader is close to an outer surface of said plate cylinder.

9. An apparatus according to claim 1, further comprising a plate pressing roller which moves between a plate pressing position to press the plate against an outer surface of said cylinder when the plate is to be mounted and a wait position where said plate pressing roller is separate from said plate cylinder, wherein said second cover member moves from the retreat position to the operative position, interlocked with movement of said plate pressing roller from the wait position to the plate pressing position.

10. An apparatus according to claim 9, further comprising a swingable lever which supports said plate pressing roller and second cover member, wherein when said lever swings in a first direction, said plate pressing roller is positioned at the wait position and said second cover member is positioned at the retreat position, and when said lever swings in a second direction opposite to the first direction, said plate pressing roller is positioned at the plate pressing position and said second cover member is positioned at the operative position.

* * * * *